US008353720B2

(12) United States Patent
Sun

(10) Patent No.: US 8,353,720 B2
(45) Date of Patent: Jan. 15, 2013

(54) CABLE CONNECTOR ASSEMBLY FOR CONNECTING HARD DISK DRIVE

(75) Inventor: Zheng-Heng Sun, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/278,141

(22) Filed: Oct. 20, 2011

(65) Prior Publication Data

US 2012/0252257 A1 Oct. 4, 2012

(30) Foreign Application Priority Data

Apr. 1, 2011 (CN) ..... 2011 1 0082005

(51) Int. Cl.
*H01R 13/73* (2006.01)

(52) U.S. Cl. ..... 439/545

(58) Field of Classification Search ..... 439/544, 439/545, 562, 563, 565, 567
See application file for complete search history.

(56) References Cited

U.S. PATENT DOCUMENTS

| | | | | |
|---|---|---|---|---|
| 4,352,538 | A * | 10/1982 | Fowler | 439/404 |
| 6,030,242 | A * | 2/2000 | Cunningham et al. | 439/247 |
| 6,039,612 | A * | 3/2000 | Brown et al. | 439/716 |
| 6,095,854 | A * | 8/2000 | Sommer et al. | 439/545 |
| 6,176,738 | B1 * | 1/2001 | Consoli et al. | 439/545 |
| 6,210,215 | B1 * | 4/2001 | Hwang | 439/545 |
| 6,312,285 | B1 * | 11/2001 | Berg et al. | 439/545 |
| 6,428,352 | B1 * | 8/2002 | Boyden | 439/545 |
| 6,776,637 | B2 * | 8/2004 | Yamada et al. | 439/247 |
| 6,843,674 | B1 * | 1/2005 | Young | 439/248 |
| 6,945,816 | B1 * | 9/2005 | Wu | 439/545 |
| 6,960,099 | B2 * | 11/2005 | McAlonis | 439/545 |
| 7,137,847 | B2 * | 11/2006 | Trout et al. | 439/465 |
| 7,168,978 | B1 * | 1/2007 | Trout et al. | 439/545 |
| 7,192,307 | B1 * | 3/2007 | Tran et al. | 439/553 |
| 7,462,067 | B1 * | 12/2008 | Whiteman et al. | 439/562 |
| 7,553,188 | B2 * | 6/2009 | Whiteman et al. | 439/607.01 |
| 7,572,144 | B1 * | 8/2009 | Wu | 439/545 |
| 7,575,472 | B1 * | 8/2009 | Wu | 439/545 |
| 7,597,587 | B1 * | 10/2009 | Duesterhoeft | 439/545 |
| 7,789,701 | B2 * | 9/2010 | Murr et al. | 439/552 |
| 7,931,496 | B2 * | 4/2011 | Ushiro et al. | 439/557 |
| 7,967,624 | B2 * | 6/2011 | Wang et al. | 439/248 |
| 8,210,861 | B2 * | 7/2012 | Tanis et al. | 439/248 |
| 2006/0291181 | A1 * | 12/2006 | Sun | 361/802 |
| 2012/0231649 | A1 * | 9/2012 | Sun | 439/345 |
| 2012/0252257 | A1 * | 10/2012 | Sun | 439/368 |

* cited by examiner

*Primary Examiner* — Ross Gushi
(74) *Attorney, Agent, or Firm* — Altis Law Group, Inc.

(57) ABSTRACT

A cable connector assembly includes a first cable connector, a second cable connector, a locking element, and a retaining frame. The first cable connector includes a first base portion. The second cable connector includes a second base portion. The retaining frame includes a front wall. The front wall defines a mounting hole. The mounting hole includes a pair of lengthwise sides and a pair of widthwise sides. The first base portion and the second base portion are slidably received in the mounting hole. The first base portion contacts one of the widthwise sides. The second base portion contacts the first base portion. The locking element is mounted in the mounting hole and squeezed between the second base portion and the other widthwise side to push the second base portion to press on the first base portion.

14 Claims, 7 Drawing Sheets

CABLE CONNECTOR ASSEMBLY FOR CONNECTING HARD DISK DRIVE

BACKGROUND

1. Technical Field

The present disclosure relates to cable connector assemblies and, particularly, to a cable connector assembly for connecting a hard disk drive (HDD).

2. Description of Related Art

Many HDDs are fixed to a frame and connected to a motherboard through a cable connector. The cable connector includes a connector, a number of power cables, and a number of data cables. The connector is fixed to the frame with screws and includes a number of contact terminals for connecting the HDD. The power cables and the data cables are fixedly connected to corresponding contact terminals for transmitting power and data between the motherboard and the HDD. However, if any power cable and/or data cable is damage, the connector needs to be replaced. This increases the cost of connectors. It is also inconvenient to assemble or disassemble the connector using screws.

What is needed therefore is a disclosure, which can overcome the limitations described.

DETAILED DESCRIPTION

Figure 1:
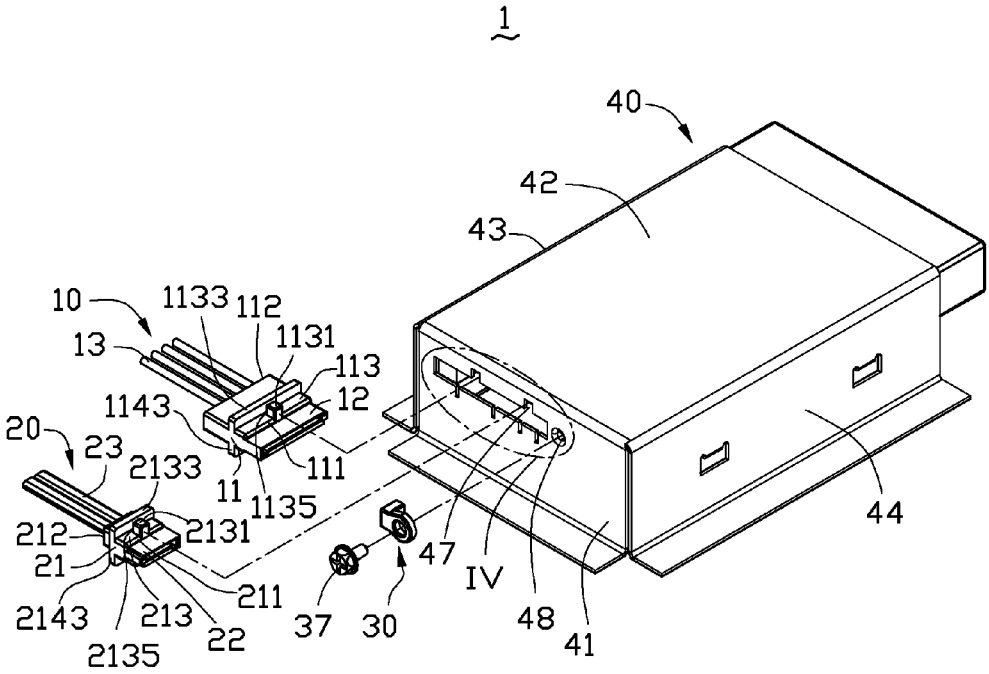
FIG. 1 is an exploded, isometric view of a cable connector assembly, according to an exemplary embodiment.
Figure 2:
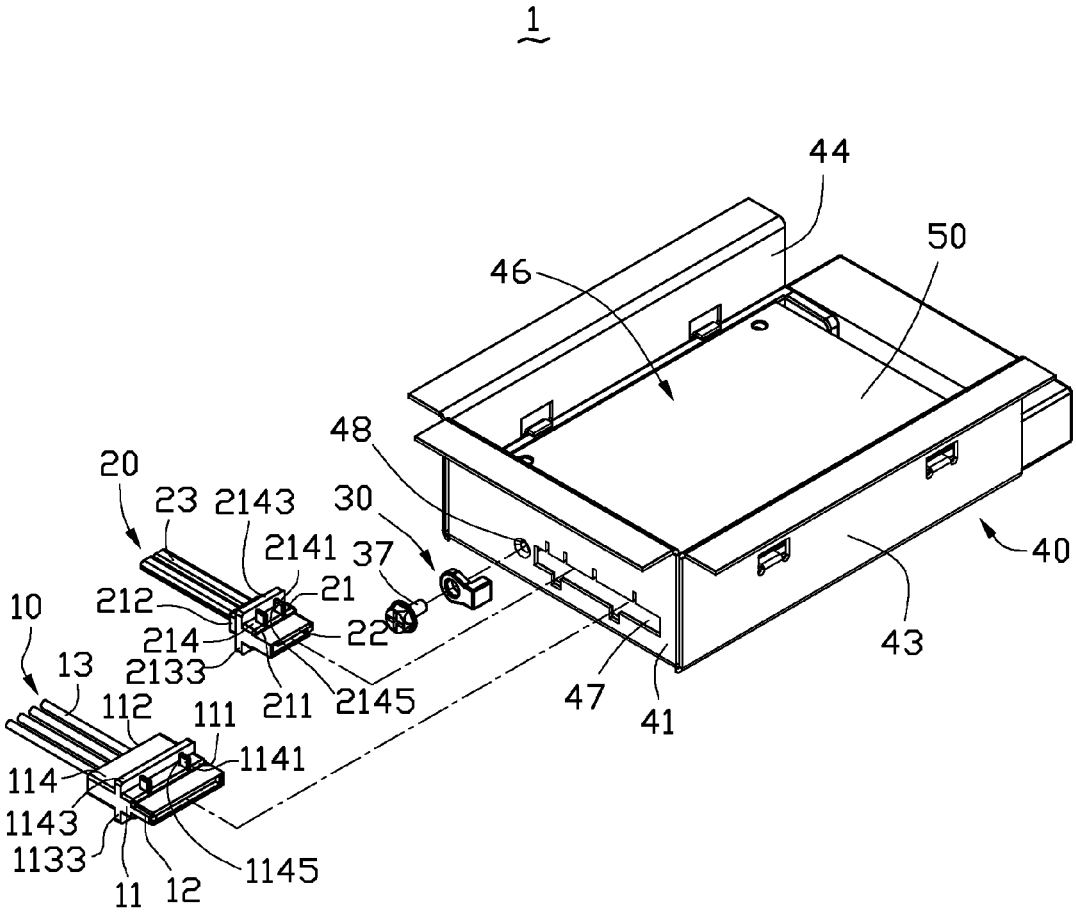
FIG. 2 is similar to FIG. 1, but viewed at another angle.

Referring to the FIGS. 1 and 2, a cable connector assembly 1, according to an exemplary embodiment, is shown. The cable connector assembly 1 includes a first cable connector 10, a second cable connector 20, a locking element 30, and a retaining frame 40.

The first cable connector 10 includes a first base portion 11, a first contact portion 12, and a number of power cables 13. The first base portion 11 is made of dielectric material and generally cuboid. The first base portion 11 includes a first end surface 111, a second end surface 112 opposite to the first end surface 111, a first mounting surface 113 substantially perpendicular to the first end surface 111, and a second mounting surface 114 opposite to the first mounting surface 113. A first protrusion 1131 and a first limiting portion 1133 extend upward from the first mounting surface 111. The first protrusion 1131 is adjacent to the first end surface 111. The first limiting portion 1133 is generally rectangular and located between the first protrusion 1131 and the second end surface 112 and parallel to the second end surface 112. A first gap 1135 is formed between the first protrusion 1131 and the first limiting portion 1133. Two second protrusions 1141 and a second limiting portion 1143 extend upward from the second mounting surface 114. The second protrusions 1141 are adjacent to the first end surface 111. The second limiting portion 1143 is opposite to the first limiting portion 1133. A second gap 1145 is formed between the second protrusions 1141 and the second limiting portions 1143.

The first contact portion 12 penetrates into the base portion 11 through the first end surface 111. The power cable 13 penetrates into the base portion 11 through the second end surface 112. The first contact portion 12 is electrically connected to the power cables 13. In this embodiment, the first cable connector 10 is a serial advanced technology attachment (SATA) power connector for connecting to a hard disk drive 50 (HDD) and supplying power to the HDD 50.

The second cable connector 20 includes a second base portion 21, a second contact portion 22, and a number of data cables 23. The second base portion 21 is made of dielectric material and generally cuboid. The second base portion 21 includes a third end surface 211, a fourth end surface 212 opposite to the second end surface 211, a third mounting surface 213 perpendicular to the third end surface 211, and a fourth mounting surface 214 opposite to the third mounting surface 213. A third protrusion 2131 and a third limiting portion 2133 extend upward from the third mounting surface 213. The third protrusion 2131 is adjacent to the third end surface 211. The third limiting portion 2133 is generally rectangular and located between the third protrusion 2131 and the fourth end surface 212 and parallel to the fourth end surface 212. A third gap 2135 is formed between the third protrusion 2131 and the third limiting portion 2133. Two fourth protrusions 2141 and a fourth limiting portion 2143 extend upward from the fourth mounting surface 214. The fourth protrusions 2141 are adjacent to the third end surface 211. The fourth limiting portion 2143 is opposite to the third limiting portion 2133. A fourth gap 2145 is formed between the fourth protrusion 2141 and the fourth limiting portions 2143. The distance from the third mounting surface 213 to the fourth mounting surface 214 is equal to the distance from the first mounting surface 113 to the second mounting surface 114.

The second contact portion 22 penetrates into the second base portion 21 through the third end surface 211. The data cables 23 penetrate into the second base portion 21 through the fourth end surface 212. The second contact portion 22 is electrically connected to the data cables 23. In this embodiment, the second cable connector 20 is an SATA data connector for connecting to and transmitting data with the HDD 50.

Figure 3:
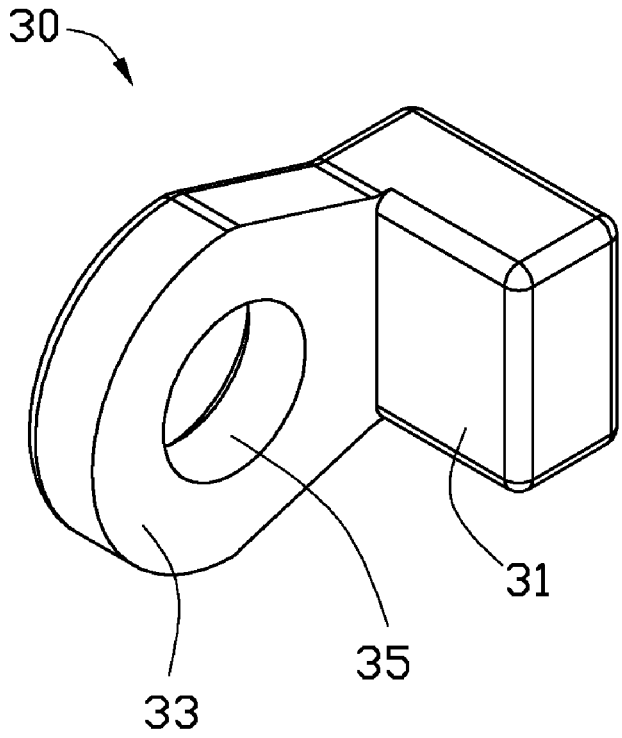
FIG. 3 is an isometric view of a locking element of the cable connector assembly of FIG. 1.

Referring to FIG. 3, the locking element 30 is made of elastic material. The locking element 30 is generally in an L shape and includes a main portion 31 and a mounting portion 33. The main portion 31 is generally cuboid. The mounting portion 33 substantially perpendicularly extends from one end of the main portion 31. The mounting portion 33 is generally annular and defines a through hole 35.

Figure 4:
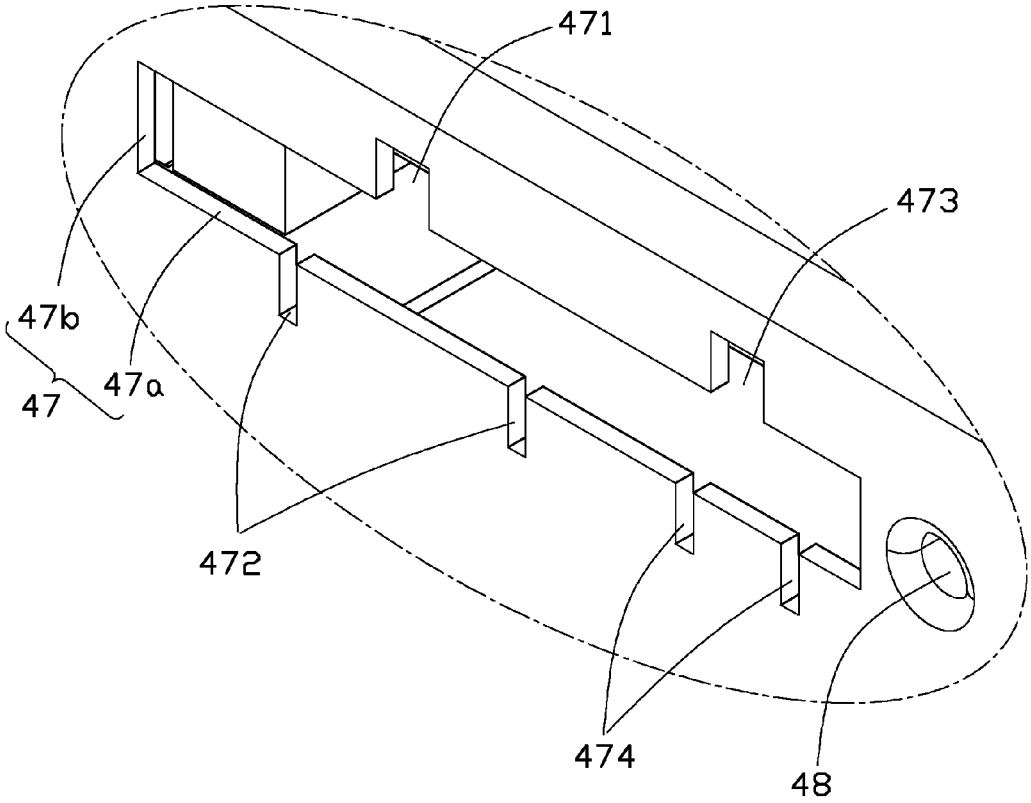
FIG. 4 is a partial enlarged view of a circled portion IV of the cable connector assembly of FIG. 1.

Referring to FIGS. 1, 2 and 4, the retaining frame 40 is made of metal and includes a front wall 41, a top plate 42, a first sidewall 43, and a second sidewall 44. The top plate 42 is generally rectangular. The front wall 41 perpendicularly extends from one side of the top plate 42. The first sidewall 43 perpendicularly extends from the top plate 42 and perpendicular to the front wall 41. The second sidewall 44 is opposite to the first sidewall 43. The front wall 41, the top plate 42, the first sidewall 43, and the second sidewall 44 cooperatively define a receiving space 46 for receiving the HDD 50.

The front wall 41 defines a mounting hole 47 communicating with the receiving space 46. The mounting hole 47 is generally rectangular and includes a pair of lengthwise sides 47*a* parallel to the top plate 42 and a pair of widthwise sides 47*b* perpendicular to the lengthwise sides 47*a*. The width of each widthwise side 47*b* is substantially equal to the distance from the first surface 113 to the second surface 114. The front wall 41 defines a first notch 471, two second notches 472, a third notch 473, and two fourth notches 474, all of them communicating with the mounting hole 47. The front wall 41 further defines a thread hole 48 at one side of the mounting hole 47 adjacent to the second sidewall 44. The thread hole 48 corresponds to the through hole 35. The distance between the mounting hole 47 and the thread hole 48 is slightly less than a length of the mounting portion 33.

The first notch 471 is defined on one of the lengthwise sides 47*a* adjacent to the top plate 42. The first notch 471 spatially corresponds to the first protrusion 1131. The second notches 472 are defined on the other lengthwise side 47*a* away from the top plate 42, each of the second notches 472 spatially corresponds to a second protrusion 1141. The first notch 471 and the second notches 472 are adjacent to the first sidewall 43. The third notch 473 is defined on the lengthwise side 47*a* adjacent to the top plate 42. The third notch 473 spatially corresponds to the third protrusion 2131. The four notches 474 are defined on the lengthwise side 47*a* away from the top plate 42. Each of the four notches 474 spatially corresponds to a fourth protrusion 2141. The third notch 473 and the fourth notches 474 are adjacent to the thread hole 48 relative to the first notch 471 and the second notches 472.

Figure 5:
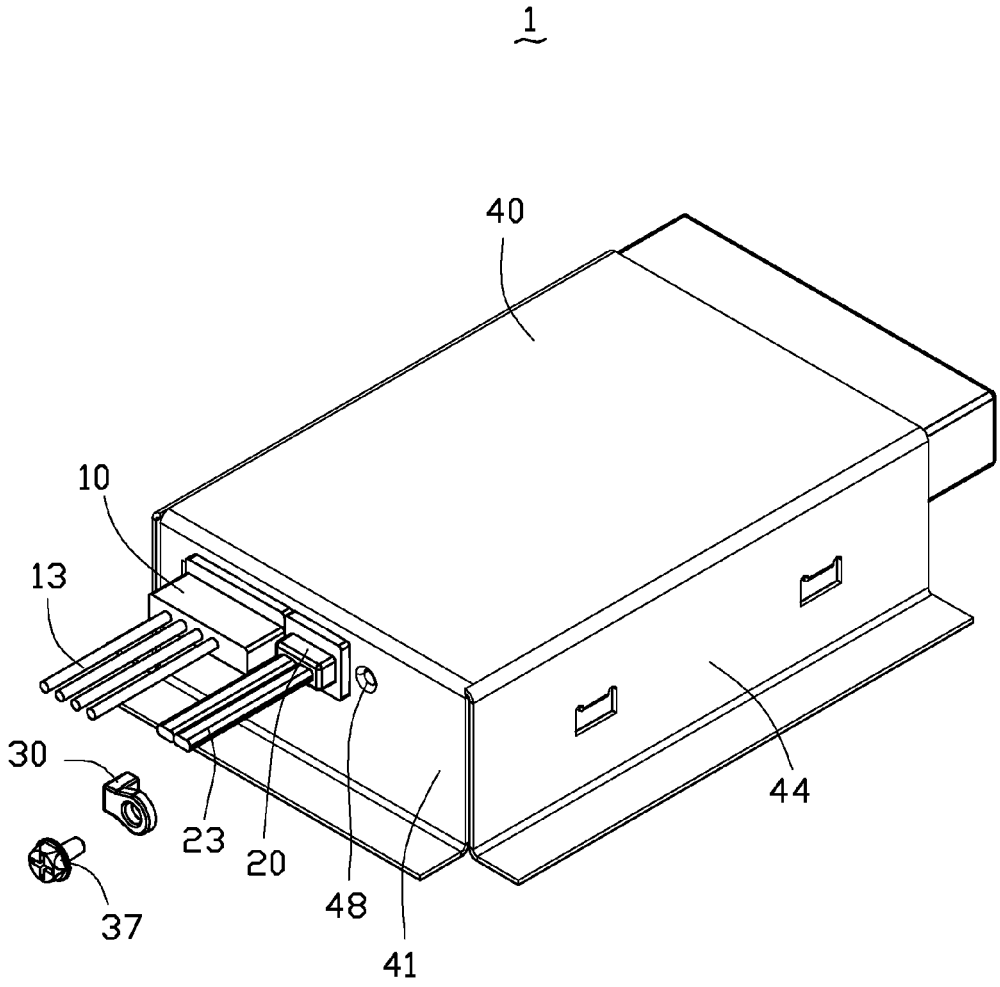
FIG. 5 is an isometric, partially assembled view of the cable connector assembly of FIG. 1.

Referring to FIGS. 1, 4, and 5, when being assembled, the first base portion 11 is received in the mounting hole 47 with the first protrusion 1131 being received in the first notch 471, the second protrusions 1231 being received in the second notches 472, and the first limiting portion 1133 and the second limiting portion 1143 being attached on the exterior surface of the front wall 41. The second base portion 21 is received in the mounting hole 47 with the third protrusion 2131 being received in the third notch 473, the fourth protrusions 2141 being received in the fourth notches 474, and the third limiting portion 2133 and the fourth limiting portion 2143 being attached on the exterior surface of the front wall 41.

Figure 6:
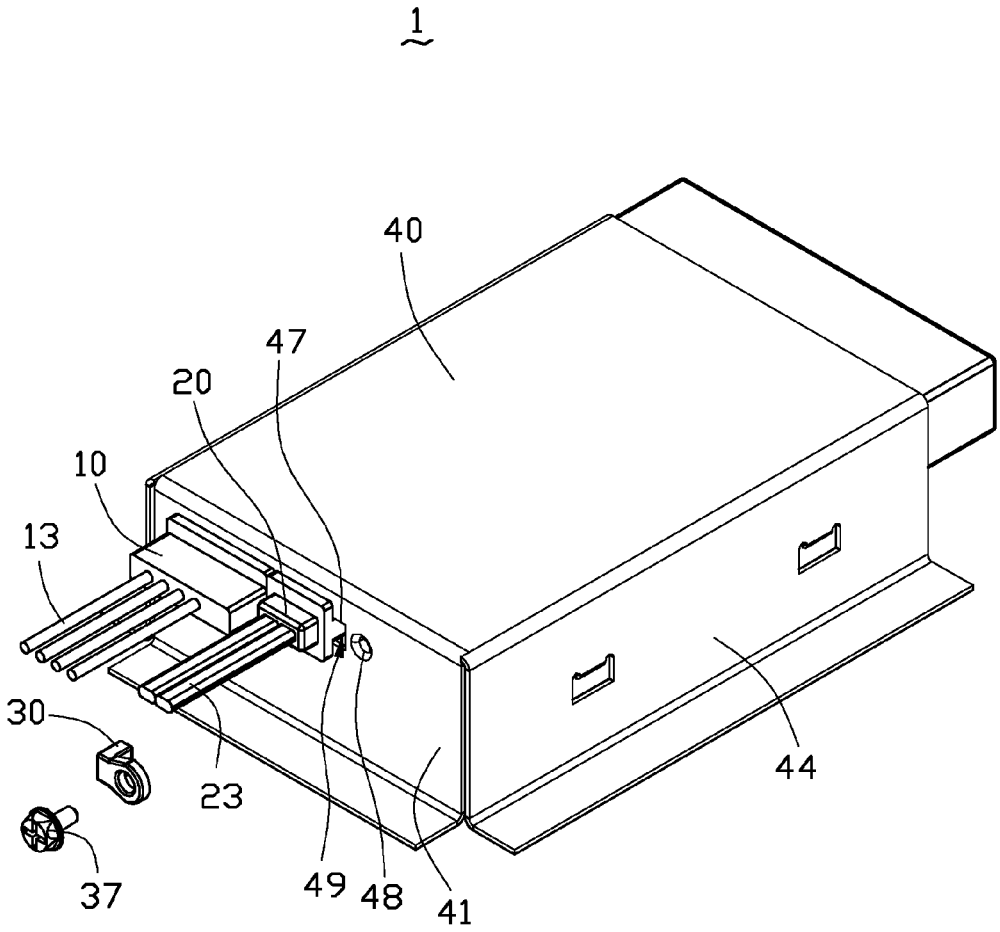
FIG. 6 is similar to FIG. 5, but showing the cable connector assembly in another state.
Figure 7:
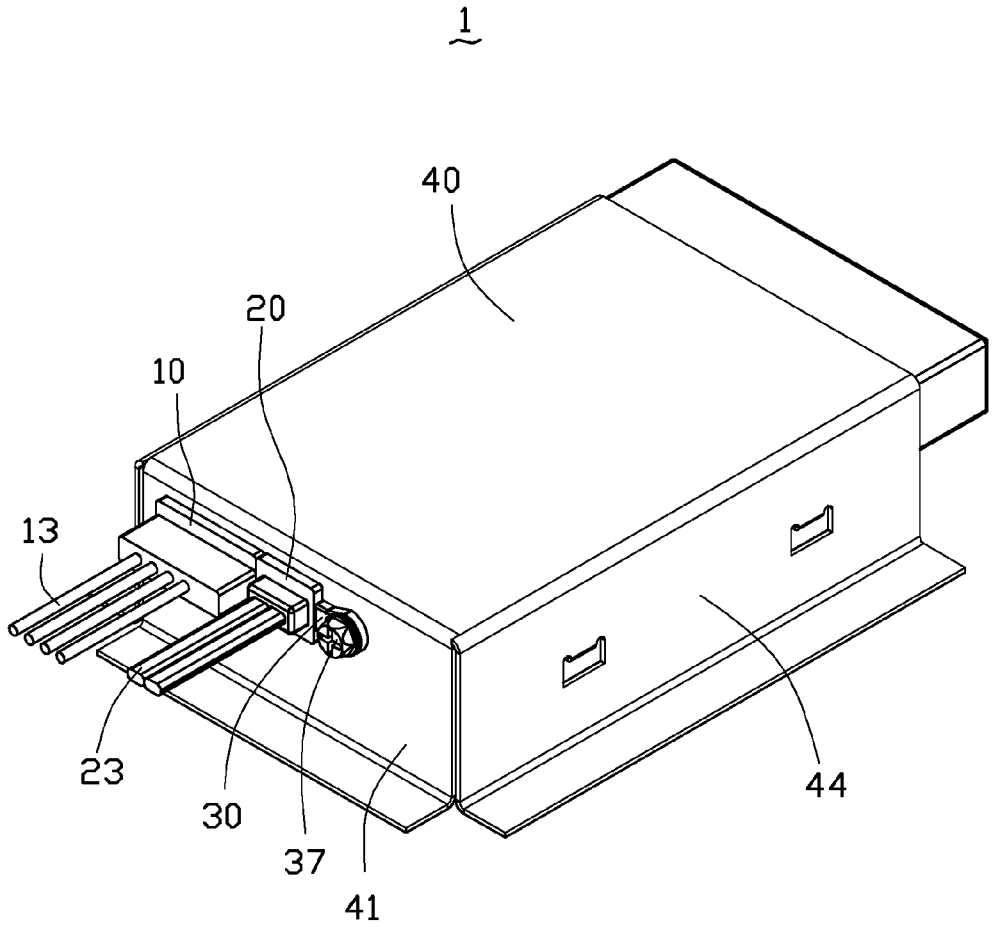
FIG. 7 is an isometric, assembled view of the cable connector assembly of FIG. 1.

Referring to FIGS. 6 and 7, the first base portion 11 is slid to and contacted to one of the widthwise sides 47*b* which is adjacent to the first sidewall 43 with the lengthwise sides 47*a* partially received in the first gap 1135 and the second gap 1145. The first contact portion 12 is connected to the HDD 50. The second base portion 21 is slid to and contacted to the first base portion 11 along the lengthwise side 47*a*, with the lengthwise sides 47*a* partially received in the third gap 2135 and the fourth gap 2145. The second contact portion 22 is connected to the HDD 50. A sum length of the first base portion 11 and the second base portion 21 along the lengthwise sides 47*a* is slightly less than the length of each lengthwise side 47*a*, a fitting gap 49 is formed between the second base portion 21 and the widthwise side 47*b* adjacent to the thread hole 48. The fitting gap 49 is a part of the mounting hole 47.

The main portion 31 is interferentially fitted into the fitting gap 49 at one side on the second base portion 21, the main portion 31 is squeezed between the second base portion 21 and the inner surface of the mounting hole 47, concretely, the main portion 31 is squeezed between the second base portion 21 and the widthwise side 47*a* adjacent to the thread hole 48, the mounting portion 33 is mounted to the front wall 41 by a screw 37 screwing in the through hole 35 and the thread hole 48. The main portion 31 elastically presses on the second base portion 21. The second base portion 21 presses on the first base portion 11. The first base portion 11 and the second base portion 21 are steadily mounted in the mounting hole 47 by the locking element 30.

When being disassembled, the screw 37 is removed from the thread hole 48 and the through hole 35. The main portion 31 is pulled out of the fitting gap 49. Then the first base portion 11 and the second base portion 21 are disconnected from the HDD 50. The second base portion 21 is slid to the widthwise side 47 adjacent to the thread hole 48 with the third protrusion 2133 and the fourth protrusions 2143 respectively aligned with the third notch 473 and the second notches 474, then the second base portion 21 is taken out of the mounting hole 47. The first base portion 11 is slid to the widthwise side 47 adjacent to the thread hole 48 with the first protrusion 1133 and the second protrusions 1143 respectively align with the first notch 471 and the second notches 472, then the second base portion 21 is taken out of the mounting hole 47.

The number of the first protrusion 1131, the second protrusion 1141, the third protrusion 2131, and the fourth protrusion 2141 is not limited to this embodiment.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A cable connector assembly, comprising:

a first cable connector comprising a first base portion;

a second cable connector comprising a second base portion;

a locking element; and a retaining frame comprising a front wall, the front wall defining a mounting hole, the mounting hole comprising a pair of lengthwise sides and a pair of widthwise sides;

wherein the first base portion and the second base portion are slidably received in the mounting hole, the first base portion contacts one of the widthwise sides, the second base portion contacts the first base portion, the locking element is detachably mounted in the mounting hole at one side of the second base portion, the locking element is squeezed between the second base portion and the other widthwise side to push the second base portion to press on the first base portion.

2. The cable connector assembly of claim 1, wherein the first base portion comprises a first mounting surface and a second mounting surface opposite to the first mounting surface, at least a first protrusion extending from the first mounting surface, and at least a second protrusion extending from the second mounting surface; the front wall defines at least a first notch and at least a second notch, the at least a first notch and the at least a second notch communicate with the mounting hole, each first notch receives a respective first protrusion, and each second notch receives a respective second protrusion.

3. The cable connector assembly of claim 2, wherein the first base portion comprises one first protrusion and two second protrusions, the front wall defines one first notch and two second notches.

4. The cable connector assembly of claim 2, wherein the first base portion further comprises a first limiting portion extending from the first mounting surface and a second limiting portion extending from the second mounting surface; the first limiting portion and the second limiting portion attach on the front wall.

5. The cable connector assembly of claim 4, wherein the first base portion defines a first gap between the at least a first protrusion and the first limiting portion and a second gap between the at least a second protrusion and the second limiting protrusion; the lengthwise sides are partially received in first gap and the second gap.

6. The cable connector assembly of claim 1, wherein the second base portion comprises a third mounting surface and a fourth mounting surface opposite to each other, at least a third protrusion extending from the third mounting surface, and at least a fourth protrusion extending from the fourth mounting surface; the front wall defines at least a third notch and at least a fourth notch, the at least a third notch and the at least a fourth notch communicate with the mounting hole, each third notch receives a respective third protrusion, each fourth notch receives a respective fourth protrusion.

7. The cable connector assembly of claim 6, wherein the first base portion comprises one third protrusion and two fourth protrusions, the front wall defines one third notch and two fourth notches.

8. The cable connector assembly of claim 6, wherein the second base portion further comprises a third limiting portion extending from the third mounting surface and a fourth limiting portion extending from the fourth mounting surface; the third limiting portion and the fourth limiting portion attach on the front wall.

9. The cable connector assembly of claim 8, wherein the second base portion defines a third gap between the at least a third protrusion and the third limiting portion and a fourth gap between the at least a fourth protrusion and the fourth limiting protrusion; the lengthwise sides are partially received in third gap and the fourth gap.

10. The cable connector assembly of claim 1, wherein the locking element comprises a main portion and a mounting portion substantially perpendicularly extending from one end of the main portion, the main portion is squeezed between the second base portion and the other widthwise side.

11. The cable connector assembly of claim 10, wherein the mounting portion defines a through hole, the front wall defines a thread hole aligned with the through hole and positioned at one side of the mounting hole, the mounting portion is mounted on the front wall by a screw screwing in the through hole and the thread hole.

12. The cable connector assembly of claim 10, wherein the locking element is made of dielectric and elastic material.

13. The cable connector assembly of claim 1, wherein the first cable connector is an SATA power connector for connecting to a HDD and supplying power to the HDD.

14. The cable connector assembly of claim 1, wherein the second cable connector is an SATA data connector for connecting to the HDD and transmitting data with the HDD.

* * * * *